US006698351B2

(12) United States Patent
Miyaguchi et al.

(10) Patent No.: US 6,698,351 B2
(45) Date of Patent: Mar. 2, 2004

(54) DOUBLE-SIDED PRINTING PRESS

(75) Inventors: Yoshitsugu Miyaguchi, Fuchu (JP); Masamichi Sasaki, Fuchu (JP)

(73) Assignee: Ryobi, LTD, Hiroshima-ken (JP)

( * ) Notice: Subject to any disclaimer, the term of this patent is extended or adjusted under 35 U.S.C. 154(b) by 0 days.

(21) Appl. No.: 10/310,535

(22) Filed: Dec. 4, 2002

(65) Prior Publication Data

US 2003/0121434 A1 Jul. 3, 2003

(30) Foreign Application Priority Data

Dec. 28, 2001 (JP) ..... 2001-400710

(51) Int. Cl.[7] ..... B65H 7/12

(52) U.S. Cl. ..... 101/230; 101/232; 101/246; 101/409; 101/410; 271/186

(58) Field of Search ..... 101/222, 232, 101/223, 230, 246, 408, 409, 410, 411; 271/65, 186

(56) References Cited

U.S. PATENT DOCUMENTS 3,772,990 A * 11/1973 Weisgerber ..... 101/230
3,884,146 A * 5/1975 Ruetschle ..... 101/183
4,127,265 A * 11/1978 Wirz et al. ..... 271/260
5,836,706 A * 11/1998 Ruhe ..... 400/636

* cited by examiner

*Primary Examiner*—Andrew H. Hirshfeld
*Assistant Examiner*—Kevin D. Williams
(74) *Attorney, Agent, or Firm*—Perkins Coie LLP; Paul L. Hickman; David B. Dort

(57) ABSTRACT

There is provided a double-sided printing press that includes a sheet-turning-over mechanism for turning sheets upside down at a sheet-turning-timing according to a set length of sheets, which has been previously set for the sheet-turning-over mechanism; and a sheet-length-detection means for detecting the length of sheets, which are fed to the sheet-turning-over mechanism; wherein where the length of sheets, which are fed to the sheet-turning-over mechanism and detected by the sheet-length-detection means, is deferent from the set length of sheets as a result of comparison therebetween, the sheets are stopped from being transferred to the sheet-turning-over mechanism.

5 Claims, 4 Drawing Sheets

DOUBLE-SIDED PRINTING PRESS

CROSS REFERENCE TO RELATED APPLICATION

This application claims priority from Japanese Patent Application No. 2001-400710, which is incorporated herein by reference.

BACKGROUND OF THE INVENTION

1. Field of the Invention

The present invention relates to a double-sided printing press that is provided with a sheet-turning-over mechanism for turning sheets upside down for printing on both sides thereof.

2. Related Art

The double-sided printing press of this type includes a sheet-turning-over mechanism for turning sheets upside down. Sheet fed from a sheet-feeding unit to a printing unit on the upstream side of the sheet-turning-over mechanism are printed on, for example, rear sides at the printing unit, and then transferred to the sheet-turning-over mechanism, in which a turn-over gripper grips a tail end of each sheet and then turns it upside down. The sheets each are then printed on a front side at a printing unit on the downstream side, and then transferred to a sheet-discharge unit.

The sheet-turning-over mechanism turns sheets upside down at a sheet-turning-timing corresponding to the length of sheets. That is, since the sheet-turning-over mechanism is designed to allow the turn-over gripper to grip the tail end of an upcoming sheet and turn the sheet upside down, it is necessary to change the timing at which the turn-over gripper grips tail ends of sheets if sheets to be processed have a different length. Therefore, the setting of the length of sheets must be made every time the length of sheets is changed.

Where an operator unintentionally skips an operation to set the length of sheets to be printed or sets a different length, the length of sheets which has been acknowledged by the printing press becomes inconsistent with the length of sheets to be actually printed. As a result, the following problems are caused.

Where the length of sheets to be actually printed is short, the tail end of a sheet passes by the turn-over gripper before it grips the tail end, resulting in failure of sheet transfer to the turn-over gripper. Thus, the sheet which failed to be transferred to the turn-over gripper falls on a lower portion of the sheet-turning-over mechanism.

On the contrary, where the length of an upcoming sheet is long as compared with the length of sheets which is previously set, the tail end of the sheet does not reach a delivering point at which the turn-over gripper timely grips the tail end. This also results in failure of sheet transfer to the turn-over gripper.

Accordingly, it is an object of the present invention to provide a double-sided printing press that is capable of preventing failure of sheet transfer in the sheet-turning-over mechanism.

SUMMARY OF THE INVENTION

According to one aspect of the present invention, there is provided a double-sided printing press that includes a sheet-turning-over mechanism for turning sheets upside down at a sheet-turning-timing according to a set length of sheets, which has been previously set for the sheet-turning-over mechanism; and a sheet-length-detection means for detecting the length of sheets, which are fed to the sheet-turning-over mechanism; wherein where the length of sheets, which are fed to the sheet-turning-over mechanism and detected by the sheet-length-detection means, is deferent from the set length of sheets as a result of comparison therebetween, the sheets are stopped from being transferred to the sheet-turning-over mechanism.

Herein, by the length of sheets is meant the length of sheets along sheet transfer direction.

With the printing press having the above arrangement, where the length of sheets to be actually processed is different from the length of sheets set for the sheet-turning-over mechanism, sheet feeding operation is stopped. Accordingly, sheets having a length different from the length of sheets previously set for the sheet-turning-over mechanism are not fed to the sheet-turning-over mechanism. As a result, in the double-sided printing operation, it is possible to prevent a failure of the sheet transfer in the sheet-turning-over mechanism.

Preferably, the sheet-length-detection means is designed to detect the length of sheets based upon the position of a constitutional member of a sheet-feeding section, in which the position of the constitutional member is changed according to the length of sheets, which are fed to the sheet-turning-over mechanism. The position of this constitutional member is adjusted according to the length of sheets every time sheets are newly set in a sheet-feeding section, thereby achieving accurate detection of the length of sheets fed to the sheet-turning-over mechanism.

Preferably, the sheet-length-detection means is designed to detect the length of sheets, which are transferred along a sheet transfer path, based upon the time required for each one of the sheets to pass a predetermined position of the sheet transfer path and a rotational angular displacement of a predetermined cylinder during the time during which each of the sheets to pass the predetermined position.

In this case, for example, the time required for each sheet to pass through a predetermined position of the sheet transfer path can be detected by using a sensor, which is designed for detecting the presence or absence of a sheet positioned therearound. This sensor can be of a simple structure that outputs two values, that is, "on" representative of the presence of a sheet, and "off" representative of the absence of a sheet. This arrangement can also omit the necessity to additionally provide an encoder or the like exclusively used for detecting the rotational angle of a predetermined cylinder, since the printing press is usually provided with the encoder or the like for the purpose of detecting the timing of impression throw-on and throw-off of a cylinder, or any other timing usually employed for a printing operation. An A/D converter circuit can also be omitted. As a result, the sheet-length detection means can be manufactured at low cost because of the arrangement that the length of sheets is detected based upon the sheet passing time and the rotational angle displacement.

Preferably, the sheet-turning-over mechanism includes a storage cylinder and a turn-over cylinder, which are located between two printing units, in which sheets are turned upside down during they are transferred from the storage cylinder to the turn-over cylinder; the rotational phase between the storage cylinder and the turn-over cylinder is changed so as to change the sheet-turning timing; a rotational-phase detection means is provided so as to detect the rotational phase between the storage cylinder and the turn-over cylinder; and the length of sheets, which is determined based upon the rotational phase detected by the rotational-phase detection means, is designated as the set length of sheets which is set for the sheet-turning-over mechanism.

With the above arrangement, the rotational phase corresponding to the sheet-turning-timing is detected, and the length of sheets determined based upon this detected result is designated as the length of sheets set for the sheet-turning-over mechanism. Thus, the length of sheets set for the sheet-turning-over mechanism can be securely and accurately detected.

Preferably, the printing press further includes input means through which the length of sheets is inputted, wherein the length of sheets inputted through the input means is designated as the set length of sheets which is set for the sheet-turning-over mechanism.

A printing press, which automatically switches the sheet-turning-over operation, generally involves inputting the length of sheets and storing the same before starting the sheet-turning-over operation. Therefore, the arrangement that the input means through which the length of sheets is inputted, and this length of sheets inputted through the input means is designated as the length of sheets set for the sheet-turning-over mechanism enables the length of sheets set for the sheet-turning-over mechanism to be found from a value stored in a memory or the like even in the absence of a special means. Thus, a simplified structure can be achieved.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

An embodiment of the double-sided printing press according to the present invention will be herein described with reference to the drawings attached hereto.

Figure 1:
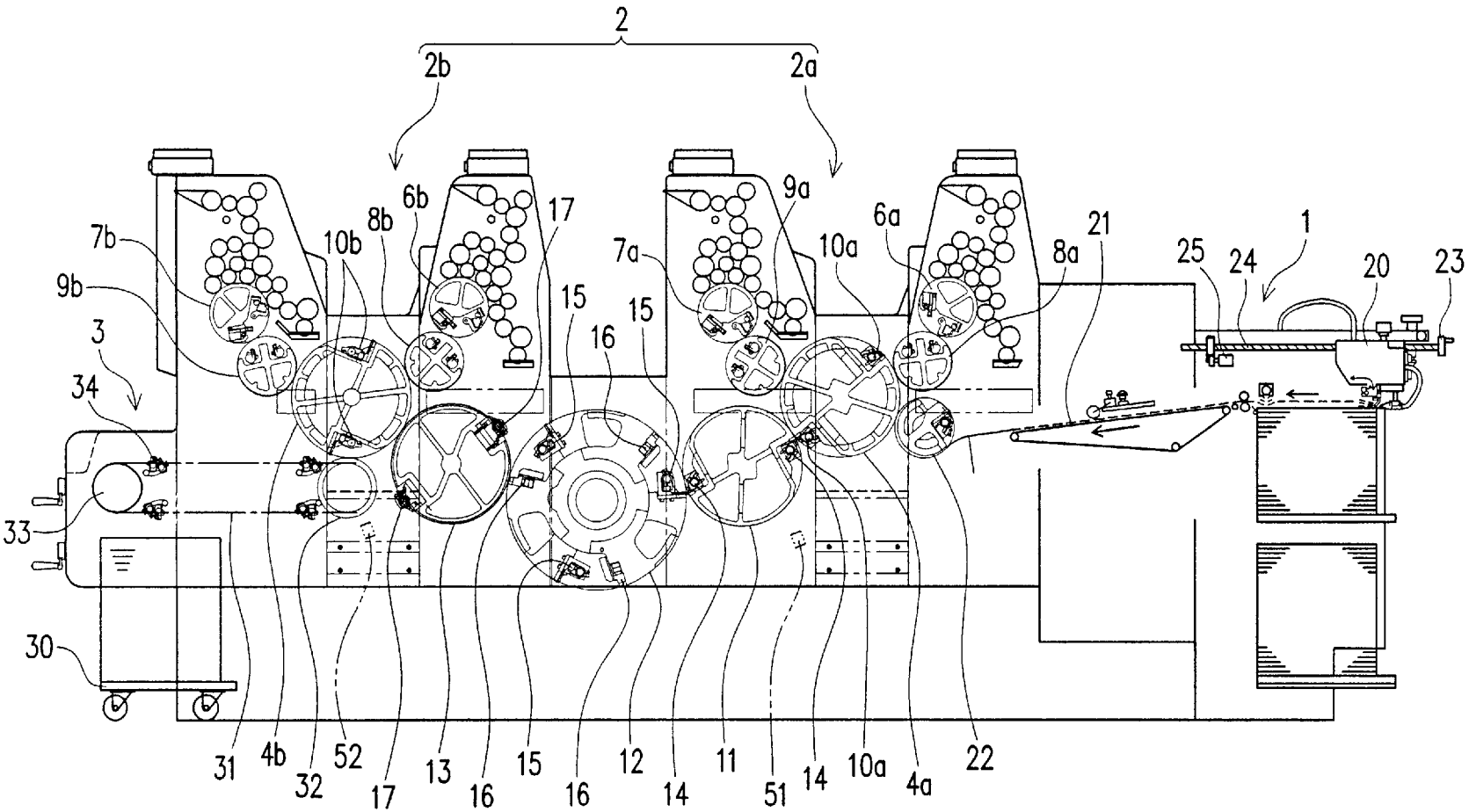
FIG. 1 is a front view of a double-sided printing press according to one embodiment of the present invention.

The double-sided printing press as illustrated in FIG. 1 is an offset printing press that is constructed so as to be switchable between a single-sided printing mode and a double-sided printing mode.

The printing press is a four color printing press, which includes printing section 2 for printing on sheets, sheet-feeding section 1 for successively feeding sheets to the printing section 2, and sheet-discharge section 3 for receiving sheets printed at the printing section 2 and discharging the same to a predetermined site. The printing section 2 is made up by first and second printing units 2*a*, 2*b*, each of which is capable of printing in two colors. Specifically, two printing units 2*a*, 2*b* have an identified structure, each having two plate cylinders 6*a*, 7*a* and rubber cylinders 8*a*, 9*a* for impression cylinder 4*a*, and plate cylinders 6*b*, 7*b* and rubber cylinders 8*b*, 9*b* for impression cylinder 4*b*. The impression cylinders 4*a*, 4*b* each have the circumferential length substantially twice as much as the length of each sheet, and respectively have grippers 10*a* and grippers, those in each cylinder being positioned 180 degrees opposite to each other 10*b* so as to respectively grip the leading ends of upcoming sheets. That is, the impression cylinders 4*a*, 4*b* each are a double diameter cylinder, which is capable of placing two sheets around the outer circumference at the same time.

Provided between the printing units 2*a*, 2*b* is a sheet-transfer section for transferring sheets from the first printing unit 2*a* of the upstream side to the second printing unit 2*b* of the downstream side. For the single-sided printing, the sheet-transfer section transfers sheets with two colors printed thereon to the second printing unit 2*b* without turning them upside down. The thus transferred sheets each are printed thereon with two colors to have a surface printed with four colors in total, and then delivered to the sheet-discharge section 3. On the other hand, for the double-sided printing, the sheet-transfer section turns sheets with rear sides printed with two colors at the first printing unit 2*a* upside down and transfers the same to the second printing unit 2*b*. Accordingly, in the double-sided printing, after the front sides of sheets printed at the second printing unit 2*b*, they are transferred to the sheet-discharge section 3.

Aligned in sequence from the upstream to the downstream of the sheet-transfer section are transfer cylinder 11, storage cylinder 12 and turn-over cylinder 13. The transfer cylinder 11 and the turn-over cylinder 13 are so-called double diameter cylinders, while the storage cylinder 12 is a so-called triple diameter drum. Accordingly, the transfer cylinder 11 is provided with a pair of grippers 14 positioned 180 degrees opposite to each other, while grippers 15 and sheet-suction units 16 are positioned 120 degrees apart from each other so as to be located at three places in total. Also, the turn-over cylinder 13 is provided with a pair of turn-over grippers 17 positioned 180 degrees opposite to each other. The turn-over cylinder 13 and the storage cylinder 12 together constitute the sheet-turning-over mechanism.

Sheets printed at the first printing unit 2*a* are transferred to the storage cylinder 12 via the impression cylinder 4*a* of the first printing unit 2*a* and then the transfer cylinder 11. At the storage cylinder 12, the leading end of each sheet is gripped by a corresponding gripper 15, while the tail end thereof is sucked and held by a corresponding sheet-suction unit 16. Then, for the single-sided printing, a corresponding turn-over gripper 17 of the turn-over cylinder 13 grips the leading end of an upcoming sheet and then receives the sheet from the corresponding gripper 15 of the storage cylinder 12, and transfers the sheet without turning it upside down to a corresponding gripper 10*b*. On the other hand, for the double-sided printing, a corresponding turn-over gripper 17 grips the tail end of a sheet and receives the sheet from a corresponding sheet-suction unit 16, and turns the sheet upside down through its pivotal motion during the rotation of the turn-over cylinder 13, and then transfers the sheet with its front and rear sides turned upside down to the impression cylinder 4*b* of the second print unit 2*b*.

When sheets having a different length are to be processed, each of the pair of sheet-suction units 16 is shifted forward or backward in the circumferential direction of the storage cylinder 12 so as to adjust the distance between the corresponding gripper 15 and sheet-suction unit 16 to the length of the sheets. Simultaneously, the rotational phase between the storage cylinder 12 and the turn-over cylinder 13 is changed so as to allow the pair of turn-over grippers 17 to properly grip tail ends of the sheets and hence turn the sheets at a sheet-turning-timing corresponding to the different length of the sheets.

The above adjustment subsequent to change in length of sheets to be processed is made manually by the operator, using a scale plate (not shown) serving as a reference, or automatically by the printing press itself based upon the sheet length inputted by the operator. Hence, this embodiment will be described by taking for example the case where the adjustment is automatically made.

The sheet-feeding section 1 for feeding sheets to the first printing unit 2*a* includes feeder head 20 for separating an uppermost sheet from a pile of sheets and feeding forward the same to the first printing unit 2*a*, and sheet-feeding cylinder 22 for transferring sheets sent from the feeder header 20 via feeder board 21 to the impression cylinder 4*a* of the first printing unit 2*a*. The feeder head 20 is constructed so as to separate an uppermost sheet from the pile of sheets by, for example, air, and suck the separated sheet and feed the same forward by suction force effected by a so-called suction foot, a kind of a sucked-sheet feeding mechanism.

Figure 2:
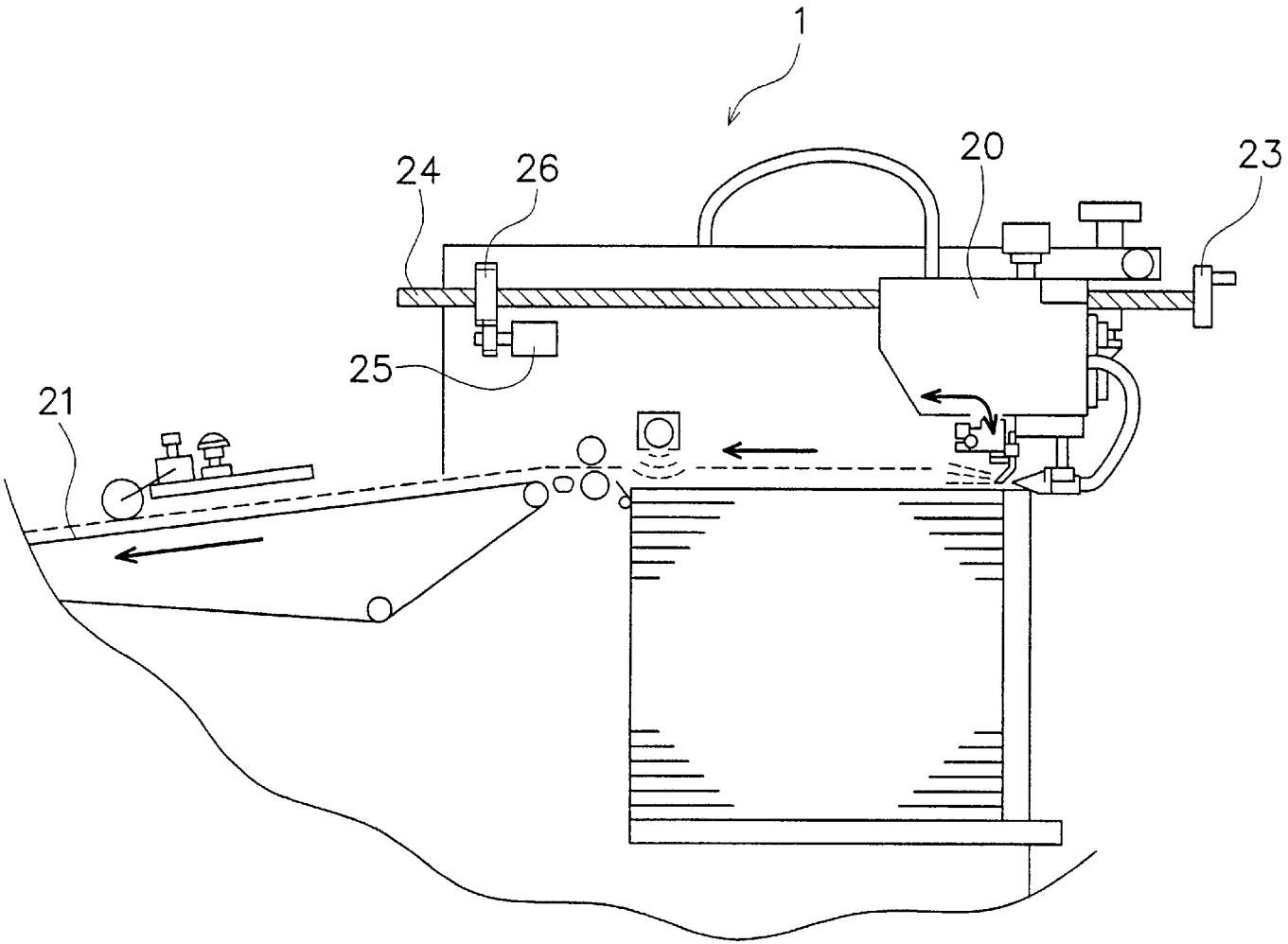
FIG. 2 is an enlarged view of an essential portion of the printing press.

The thus arranged feeder head 20 is to perform separation, suction and feeding operations on the rear side (tail end side) of sheets, and therefore is located on a portion closer to the tail ends of sheets. The sheet-feeding section 1 is also provided with a shifting mechanism for shifting the feeder head 20 forward and rearward to match the feeder head 20 in position to the length of sheets to be actually processed. While the shifting mechanism shifts the feeder head 20 manually or automatically by using a motor or any other driving mechanism, this embodiment will be described by taking for example the manual operation. FIG. 2 illustrates one example, in which a screw feed mechanism serving as the shifting mechanism is employed. Handle 23 as a manipulating device is rotated, thereby rotating screw shaft 24. This rotation causes forward and rearward shifting of the feeder head 20, which is meshed with the screw shaft 24.

In this embodiment, the sheet-feeding section 1 is provided with a sheet-length detection means for detecting the length of sheets fed to the sheet-turning-over mechanism. The sheet-length detection means is designed to detect the length of sheets fed to the sheet-turning-over mechanism based upon the position of an element of the sheet-feeding section 1, which element is shiftable forward and rearward or in the lengthwise direction of sheets to a position corresponding to the length of sheets actually fed. Specifically, the length of sheets fed to the sheet-turning-over mechanism is detected based upon the position of the feeder head 20. More specifically, potentiometer 25 is mounted to the screw shaft 24 via gear 26 so as to serve as the sheet-length detection means. The potentiometer 25 detects the rotational angle of the screw shaft 24 so as to detect the position of the feeder head 20 relative to the forward and rearward direction, and hence detects the length of piled sheets based upon the position of the feeder head 20. The potentiometer 25 may be replaced by a rotary encoder or any other angular censer.

Returning to FIG. 1, the sheet-discharge section 3 includes sheet-discharge endless chain 31 for receiving sheets from the impression cylinder 4*b* of the second printing unit 2*b* and transferring the same to sheet-discharge table 30, which functions as an elevation table. The sheet-discharge endless chain 31 runs between sheet-discharge sprocket 32 adjacent to the impression cylinders 4*b* and sheet-discharge sprocket 33 disposed above the sheet-discharge table 30, and is provided with chain grippers 34 with predetermined spacing from each other for respectively gripping the leading ends of sheets. The chain grippers 34 receive sheets from the impression cylinder 4*b* by the movement of the sheet-discharge endless chain 31, transfer the same to a portion above the sheet-discharge table 30.

Figure 3:
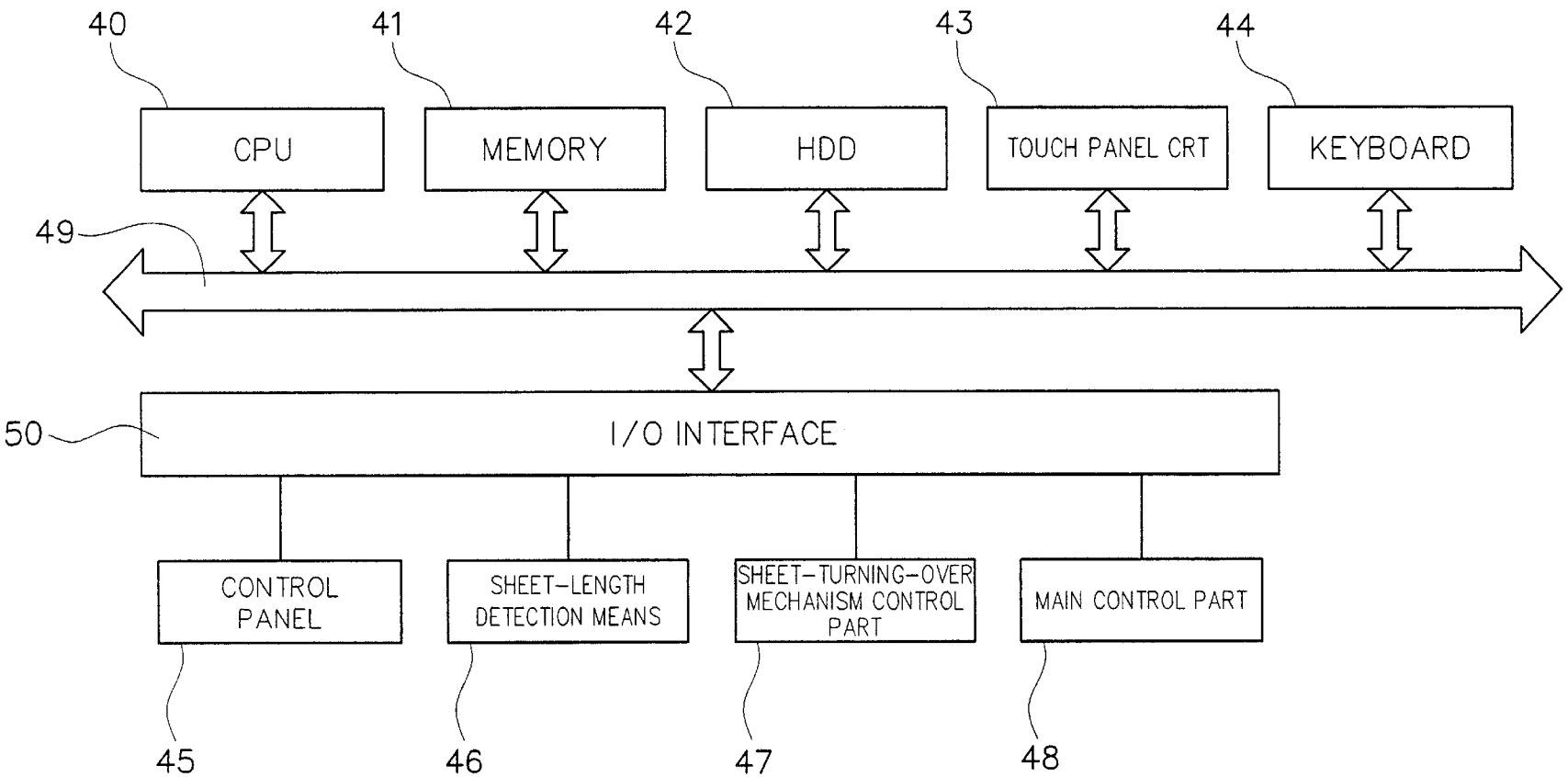
FIG. 3 is a view illustrating a hardware arrangement of a control unit of the double-sided printing press.

Now, the description will be made for the control unit for controlling the respective members of the printing press. FIG. 3 illustrates a hardware arrangement making up a main part of the control unit of the printing press by using a CPU. The control unit includes CPU 40, memory 41, hard disk 42, touch panel CRT 43, keyboard 44, control panel 45, sheet-length detection means 46, sheet-turning-over mechanism control part 47, main control part 48 and bus line 49. The CPU 40 controls the respective parts via the bus line 49 according to a control program stored in the hard disk 42. The memory 41 stores the length of sheets, as well as various set values, calculated results, etc. The control panel 45, the keyboard 44 (including a numerical keyboard) and the touch panel CRT 43 are to allow the operator to input various printing parameters. The control panel 45, the sheet-length detection means 46, the sheet-turning-over mechanism control part 47 and the main control part 48 are connected with the bus line 49 via interface 50. The sheet-turning-over mechanism control part 47 adjusts the spaced distance between the grippers 15 and the sheet-suction units 16 of the storage cylinder 12 upon receiving signals from the CPU 40, as well as varies the rotational phase between the storage cylinder 12 and the turn-over cylinder 13 so as to control the timing at which the sheet-turning-over mechanism takes a sheet turning operation (i.e., the sheet-turning-timing). Also, the main control part 48 controls a main motor upon receiving signals from the CPU 40 so as to selectively start and stop the main motor. Once the main motor has been started, the respective cylinders and associated members are operated in association with each other so that the sheet feeding operation is started, thereby allowing sheets to be fed from the sheet-feeding section 1 and transferred to the next stage. Once the main motor has been stopped, the sheet feeding operation is stopped so as to stop sheets from being fed from the sheet-feeding section 1, and the respective cylinders and their associated members are simultaneously stopped, thus stopping the sheet transfer operation.

Figure 4:
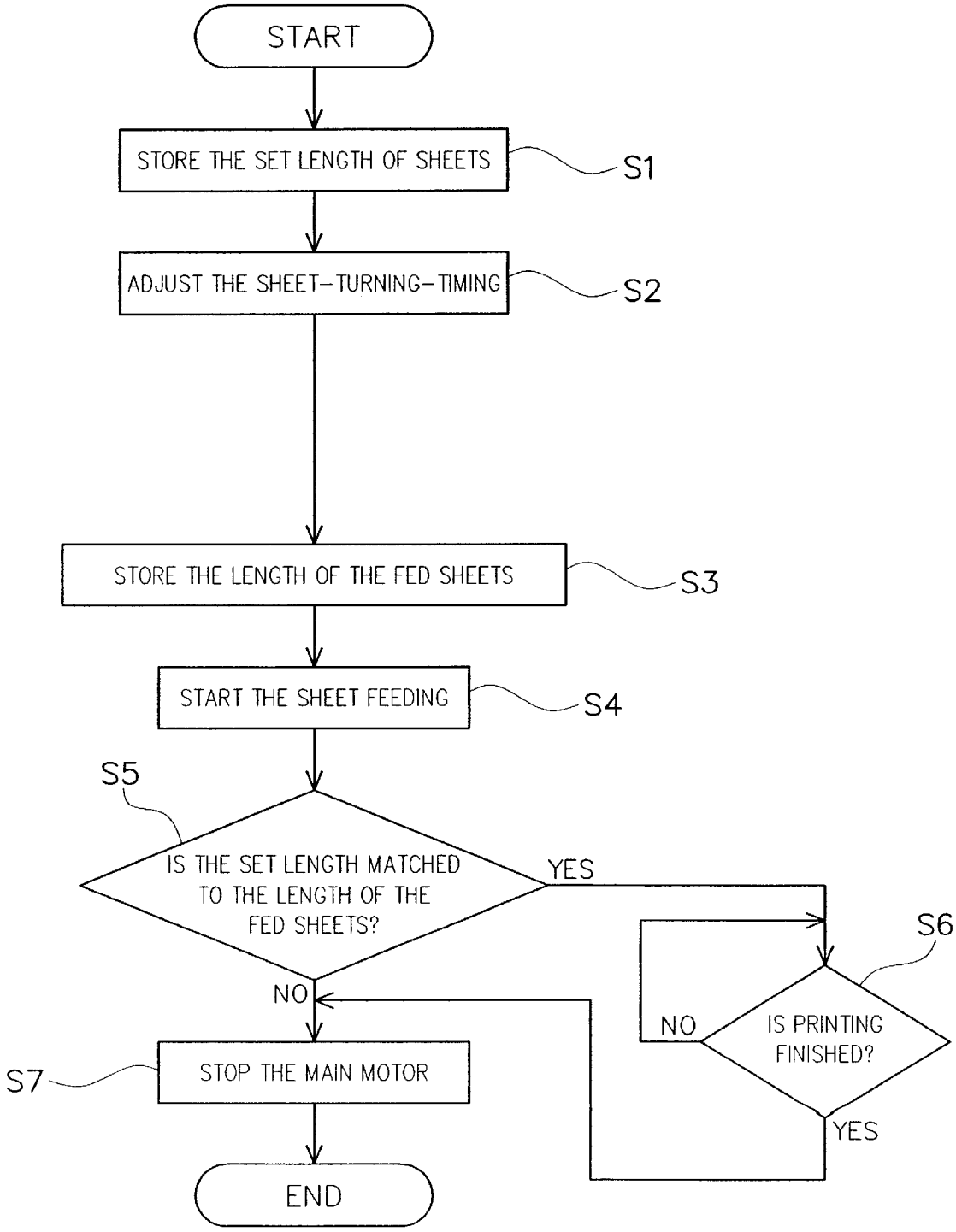
FIG. 4 is a flowchart of a control program.

Now, the description will be made for the main part of the program stored in the hard disk 42 with reference to the flow chart of FIG. 4. First, the operator inputs the length of sheets to be set to the sheet-turning-over mechanism (a set length) so as to set the sheet-turning-timing of the sheet-turning-over mechanism. The spaced distance between the grippers 15 and the sheet-suction units 16, and the sheet-turning-timing of the sheet-turning-over mechanism must be set corresponding to the length of sheets to be processed. Accordingly, the setting operation is made by inputting the length of sheets to be printed. This input operation is made through the control panel 45, the touch panel CRT 43, the keyboard 44 or the like. In this regard, the control panel 45, the touch panel CRT 43 and the keyboard 44 serve as inputting means for inputting the set length of sheets. The CPU 40 allows the memory 41 to store the set length thus inputted in Step S1. Here, by the set length is meant the length of sheets set for the sheet-turning-over mechanism, that is, the length of sheets recognized by the sheet-turning-over mechanism, which corresponds to the spaced distance between the grippers 15 and the sheet-suction units 16, and the sheet-turning-timing.

Then, the CPU 40 sends signals to the sheet-turning-over mechanism control part 47 so as to adjust the sheet-turning-timing of the sheet-turning-over mechanism based upon the set length of sheets thus inputted (Step S2). Specifically, the spaced distance between the grippers 15 and the sheet-suction units 16 of the storage cylinder 12 is adjusted to the length of sheets, and the rotational phase between the storage cylinder 12 and the turn-over cylinder 13 is adjusted to a value corresponding to the set length of sheets.

Then, the operator sets sheets to be processed in the sheet-feeding section 1, and rotates the handle 23 by an amount corresponding to the length of the sheets thus set to shift the feeder head 20 to the rear end of the sheets. When the feeder head 20 is shifted forwards and rearwards, the potentiometer 25 as the sheet-length detection means 46 detects the rotation of the screw shaft 24, and outputs the detected result to the CPU 40 in real time. The CPU 40 then allows the memory 41 to store the length of the fed sheets detected by the potentiometer 25 (Step S3). Here, by the length of the fed sheets is meant the length of sheets to be actually processed, and the length of sheets fed to the sheet-turning-over mechanism. Thus, the length of sheets is detected based upon the position of the feeder head 20, which results in a secured detection of the length of sheets.

Subsequently to input of the information representative of the start of sheet feeding through the control panel 45 or the like, the CPU 40 sends signals to the main control part 48 to actuate the main motor (Step S4), and simultaneously actuate the respective members of the printing press (sheet-feeding section 1, first and second printing units 2*a*, 2*b*, members of the sheet-turning-over mechanism, i.e., the storage cylinder 12 and the turn-over cylinder 13, and the sheet-discharge section 3). Then, the CPU 40 compares the set length of sheets stored in the memory 41 with the length of the fed sheets in Step S5. Where the set length and the length of the fed sheets are matched to each other, the CPU 40 proceeds from Step S5 to Step S6 to print a predetermined number of sheets and send signals to the main control part 48 once the printing of the predetermined number of sheets is finished, thereby stopping the main motor. On the other hand, where the set length and the length of the fed sheets are different from each other, the CPU 40 proceeds from Step S5 to Step S7, and immediately sends signals to the main control part 48 to stop the main motor. Therefore, even if a difference exists between the set length and the length of the fed sheets, sheets are not fed to the turn-over cylinder 13 so that a failure in transferring sheets from the storage cylinder 12 to the turn-over cylinder 13 is unlikely to occur.

This embodiment has been explained above by taking for example the case that the input means for inputting the length of sheets is provided, and the length of sheets inputted through this input means is designated as the set length (i.e., the length of sheets set for the sheet-turning-over mechanism). Alternatively to this arrangement, a rotational-phase detection means for detecting the rotational phase of the turn-over cylinder 13 relative to the storage cylinder 12 may be provided so that the length of sheets is calculated based upon the rotational phase detected by the rotational-phase detection means. According to this arrangement, the calculated length of sheets is designated as the set length.

As described above, in order to change the length of sheets, the rotational phase between the storage cylinder 12 and the turn-over cylinder 13 must correspondingly be changed. The turn-over cylinder 13 is rotated in association with the rotational members located on the downstream thereof such as the impression cylinder 4*b* of the second printing unit 2*b*, and the sheet-discharge sprockets 32, 33. Therefore, the changing the rotational phase between the storage cylinder 12 and the turn-over cylinder 13 causes simultaneous changing of the rotational phase between the storage cylinder 12 and any rotational members, which are located on the downstream side of the turn-over cylinder 13 and rotated in association with the same. Sensors such as a proximity sensor or photosensor are provided to detect the rotation of the turn-over cylinder 13 or the rotational members, which are located on the downstream side of the turn-over cylinder 13 and rotated in association with the same. For example, a sensor such as a proximity sensor is provided to detect the rotation of each of the rotational members at a specific portion so as to output an on signal at every time when the sensor detects each rotation of the aforesaid each of the rotational members. The sensor, which is represented by reference numeral 52 in FIG. 1, is arranged for example on the radially outer side of the sheet-discharge sprocket 32 with a predetermined spacing.

On the other hand, the printing press is provided on for example the sheet-feeding cylinder 22 with a rotary encoder (not shown) so as to keep track of the rotation of each rotational member. This rotary encoder is not necessarily provided on the sheet-feeding cylinder 22. Rather, it may be provided on the storage cylinder 12, or any rotational member located on the upstream side of the storage cylinder 12 and rotated in association with the same. The sheet-feeding cylinder 22 also corresponds to one of the rotational members. In addition, the transfer cylinder 11, the impression cylinder 4*a* of the printing unit 2*a* and the like also correspond to those of the rotational members.

Accordingly, the rotational phase of the turn-over cylinder 13 relative to the storage cylinder 12, that is, the sheet-turning-timing can be tracked based upon the rotational angle at which the sensor 52 outputs an on signal relative to the rotation of the storage cylinder 12 or any other rotational member being rotated in association with the same, which rotation is tracked through the rotary encoder. The length of sheets can be determined based upon its tracked rotational phase by using a predetermined calculation formula or a comparative table. That is, the rotational phase of the turn-over cylinder 13 relative to the storage cylinder 12 is detected by the combination of the sensor 52 provided for the turn-over cylinder 13 and its associated members, and the rotary encoder provided for the storage cylinder 12 and its associated members, and then the length of sheets determined based upon this rotational phase can be designated as the set length of sheets. In this case, the sensor 52 and the rotary encoder together constitute the rotational-phase detection means. This arrangement is suitable for a printing press, in which the sheet-turning-timing is manually adjusted, and more specifically a printing press, in which the spaced distance between the grippers 15 and the sheet-suction units 16, the rotational phase between the storage cylinder 12 and the turn-over cylinder 13, or the like are manually adjusted. According to this arrangement, the length of sheets is determined by detecting the actual rotational phase, thus achieving secured and accurate detection of the length of sheets.

Also, according to the above arrangement, in FIG. 3, the rotational-phase detection means is connected with the CPU 40 via the interface 50, in which for example the rotational-phase detection means sends a detected rotational phase to the CPU 40, which in turn calculates the length of sheets based upon the received rotational phase and stores the result in the memory 41.

A sheet detection manner employed by the sheet-length detection means 46 is also not limited to a manner in which it detects the length of sheets based upon the position of the feeder head 20. Rather, the length of sheets may be directly detected during the sheets are fed along the transfer path. In a similar manner as the above, various sensors may be used as the sheet-length detection means 46. For example, the sensor is located on the radially outer side of the transfer cylinder 11 with a predetermined spacing, as illustrated in FIG. 1. The sensor 51 outputs an on signal during each sheet passes by. Thus, the length of sheets on the transfer cylinder 11 can be detected based upon the time required for each sheet to pass by the sensor 51 and a signal produced by the rotary encoder, which is representative of a rotational angular displacement of the sheet-feeding cylinder 22 or any other cylinder during the time during which each sheet to pass the sensor 51. The sensor 51 may be provided at a different place, such as on the outer side of the sheet-feeding cylinder 22. In this case, the sensor 51 and the rotary encoder together constitute the sheet-length detection means.

That is, where the sheet-length detection means is designed to detect the length of sheets, which are transferred along the sheet transfer path, based upon the time required for each sheet to pass through a predetermined position of the sheet transfer path extending from the sheet-feeding section 1 to the sheet-turning-over mechanism, and a rotational angular displacement of a predetermined cylinder such as the sheet-feeding cylinder 22 during the time during which each sheet passes the predetermined position, the sheet-length detection means 46 can have a simplified structure.

In any event, where the set length and the length of the fed sheets are different from each other, the sheets are instantly stopped from being fed so that sheets having a length different from the set length are not fed to the sheet-turning-over mechanism. Thus, in the double-sided printing operation, it is possible to prevent a failure in transferring sheets in the sheet-turning-over mechanism.

It is also possible to change the cylinder arrangement, the number of printing sections and the like.

This specification is by no means intended to restrict the present invention to the preferred embodiments set forth therein. Various modifications to the double-sided printing press, as described herein, may be made by those skilled in the art without departing from the spirit and scope of the present invention as defined in the appended claims.

What is claimed is:

1. A double-sided printing press comprising:

a sheet-turning-over mechanism for turning sheets upside down at a sheet-turning-timing according to a set length of sheets, which has been previously set for said sheet-turning-over mechanism;

a sheet-length-detection means for detecting the length of sheets, which are fed to said sheet-turning-over mechanism; wherein where the length of sheets, which are fed to said sheet-turning-over mechanism and detected by said sheet-length-detection means, is deferent from said set length of sheets as a result of comparison therebetween, the sheets are stopped from being transferred to said sheet-turning-over mechanism.

2. The double-sided printing press according to claim 1, wherein said sheet-length-detection means is designed to detect the length of sheets based upon the position of a constitutional member of a sheet-feeding section, said position of said constitutional member being changed according to the length of sheets, which are fed to said sheet-turning-over mechanism.

3. The double-sided printing press according to claim 1, wherein said sheet-length-detection means is designed to detect the length of sheets, which are transferred along a sheet transfer path, based upon the time required for each one of said sheets to pass a predetermined position of said sheet transfer path and a rotational angular displacement of a predetermined cylinder during said time during which each of said sheets to pass said predetermined position.

4. The double-sided printing press according to claim 1, wherein:

said sheet-turning-over mechanism comprises a storage cylinder and a turnover cylinder, which are located between two printing units, in which sheets are turned upside down during they are transferred from said storage cylinder to said turn-over cylinder;

the rotational phase between said storage cylinder and said turn-over cylinder is changed so as to change the sheet-turning timing;

a rotational-phase detection means is provided so as to detect the rotational phase between said storage cylinder and said turn-over cylinder; and the length of sheets, which is determined based upon the rotational phase detected by said rotational-phase detection means, is designated as said set length of sheets which is set for said sheet-turning-over mechanism.

5. The double-sided printing press according to claim 1, which further comprises input means through which the length of sheets is inputted, wherein said length of sheets inputted through said input means is designated as said set length of sheets which is set for said sheet-turning-over mechanism.

* * * * *